United States Patent [19]

Christopher

[11] Patent Number: 4,461,426

[45] Date of Patent: Jul. 24, 1984

[54] ADJUSTABLE AERIAL SPRAY NOZZLE APPARATUS

[76] Inventor: Gilman O. Christopher, 924 W. 11th Pl., Mesa, Ariz. 85201

[21] Appl. No.: 329,232

[22] Filed: Dec. 10, 1981

[51] Int. Cl.[3] ..... B05B 1/12

[52] U.S. Cl. ..... 239/394

[58] Field of Search ..... 239/394, 396, 390

[56] References Cited

U.S. PATENT DOCUMENTS 2,027,567 1/1936 Webb ..... 239/390

2,711,925 6/1955 King ..... 239/390

4,141,504 2/1979 Anderson ..... 239/396 X 4,221,334 9/1980 Christopher ..... 239/394

FOREIGN PATENT DOCUMENTS 1124211 6/1956 France .

*Primary Examiner*—John J. Love

*Attorney, Agent, or Firm*—H. Gordon Shields

[57] ABSTRACT

Aerial spray nozzle is selectively adjustable for rate of delivery of the fluid to be sprayed and for droplet size of the sprayed fluid.

5 Claims, 5 Drawing Figures

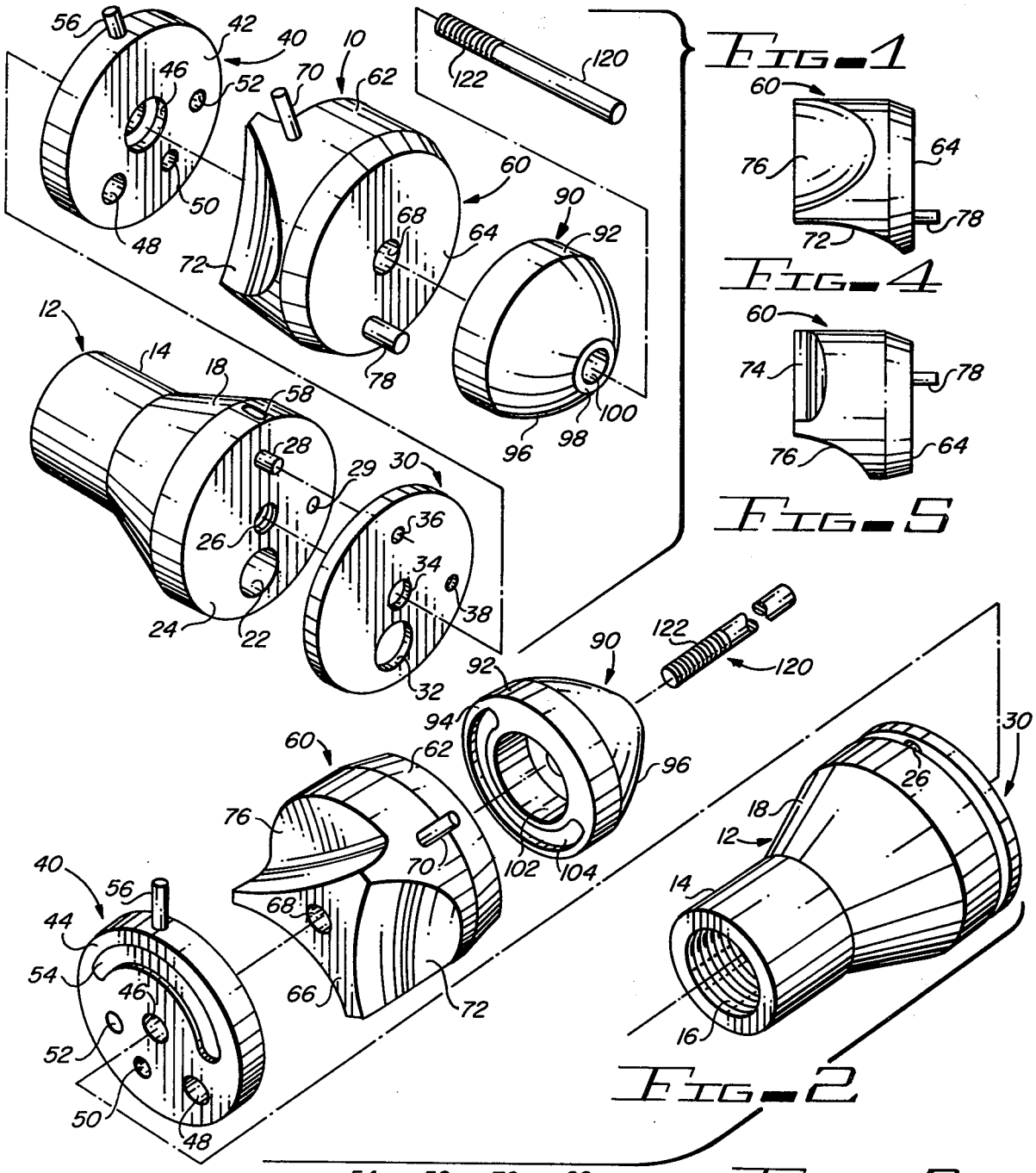
FIG-1
FIG-4
FIG-5
FIG-2
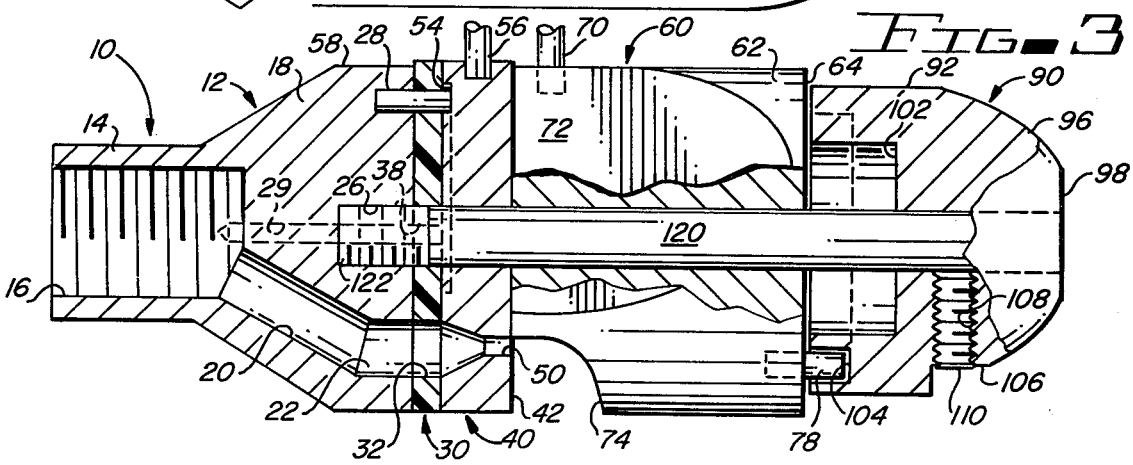
FIG-3

ADJUSTABLE AERIAL SPRAY NOZZLE APPARATUS

BACKGROUND OF THE INVENTION

1. Field of the Invention

This invention relates to spray nozzles and, more particularly, to spray nozzles for aerial spraying having adjustable rates of delivery for the sprayed liquid.

2. Description of the Prior Art

U.S. Pat. No. 4,221,334, dated Sept. 9, 1980, the inventor of which is the inventor of the apparatus of the present invention, discloses a nozzle for aerial spraying which includes a plurality of orifices, each of a different size, for delivering selectively different quantities of liquid to be sprayed from the nozzle. The apparatus also includes a circular concave face adjacent to the discharge nozzle against which the liquid flows from the discharge nozzle for providing a fan-shaped spray of the fluid. In the apparatus of the '334 patent the quantity or flow of the liquid to be sprayed may be selectively varied by aligning a particular sized hole or orifice with a fluid supply port, but the particular droplet size of the fluid is predetermined by the curvature of the face that the fluid impinges upon. Thus, while the quantity of the fluid sprayed may be varied, the spray is of a particular particle size and a particular fan-shaped configuration regardless of the particular delivery orifice selected.

Prior to the '334 patent, spray apparatus for aerial delivering generally included a fixed nozzle assembly. If a different flow rate were desired from the flow rate provided by the nozzles on a particular airplane, each nozzle had to be changed to a different nozzle which provided a different flow rate.

With the apparatus of the '334 patent, the same nozzle could be utilized by merely changing the orifice size aligned with the fluid delivery port. The prior art nozzles, again prior to the '334 apparatus, provided a generally cone-shaped swirl of the fluid as it left the spray nozzles or heads. The conical spray took a period of time, which was measured in terms of height before a uniform spray, or a continuous sheet of spray, was formed by the separate conical spray configurations. The apparatus of the '334 patent provides that the spray is initially distributed in a fan shape. Accordingly, the fluid sprayed from the spray heads combines with the spray from the adjacent spray heads to form a relatively uniform curtain very quickly after departure from the spray nozzles. The provision of the fan-shaped spray emanating from each nozzle thus provides a relatively uniform sheet of spray from the aircraft regardless of the height of the aircraft above the delivery target, which is usually an agricultural crop, etc.

The aerial spray apparatus of the prior art does not suggest the provision of changing the droplet size of the spray. By varying the droplet size, a particular spray can be designed or determined in accordance with the desired application of the fluid being sprayed. In other words, the droplet size and delivery quantity may, with provisions for an adjustable nozzle and an adjustable particle size, be coordinated or correlated with respect to the intended target of the spray activity. Thus it may be desirable to have different droplet sizes for spraying a cotton crop than, for example, when spraying trees. The provision of both a variable delivery rate and a variable droplet or particle size accordingly appears to be highly desirable.

SUMMARY OF THE INVENTION

The invention described and claimed herein comprises a spray head having a plurality of spray delivery orifices, each of which is different to provide a different flow rate and which may be selectively aligned with a fluid delivery port to provide variation in flow rate and a spray head having a plurality of curved faces, each of which is selectively alignable with a spray delivery orifice to vary the particle size of the fluid sprayed from the orifice.

Among the objects of the present invention are the following:

To provide new and useful aerial spray nozzle apparatus;

To provide new and useful nozzle apparatus having selectively variable delivery orifices;

To provide new and useful spray nozzle having a selectively adjustable nozzle for varying the quantity of delivered spray;

To provide new and useful spray apparatus having a selectively variable particle size for the sprayed fluid;

To provide new and useful apparatus for selectively varying the particle size of sprayed liquid; and To provide new and useful liquid spray nozzle apparatus having a selectible flow rate for the liquid and a selectible particle size for the liquid.

BRIEF DESCRIPTION OF THE DRAWING

FIG. 1 is an exploded perspective view of the apparatus of the present invention.

FIG. 2 is another exploded perspective view of the apparatus of the present invention from the reverse direction of FIG. 1.

FIG. 3 is a view in partial section of the assembled apparatus of the present invention.

FIG. 4 is a side view of a portion of the apparatus of the present invention.

FIG. 5 is a side view of a portion of the apparatus of the present invention rotated from the position shown in FIG. 4.

DESCRIPTION OF THE PREFERRED EMBODIMENT

FIG. 1 is an exploded perspective view of aerial spray nozzle apparatus 10 of the present invention, viewing the apparatus from the front. FIG. 2 is an exploded perspective view of the spray nozzle apparatus 10, viewing the spray nozzle apparatus 10 from the rear. FIGS. 1 and 2 accordingly are exploded perspective views of the nozzle apparatus 10 showing the nozzles from opposite directions. FIG. 3 is a view in partial section of the nozzle apparatus 10, with the nozzle assembled. For the following general discussion of the spray nozzle apparatus 10, reference will be made to FIGS. 1, 2, and 3.

The aerial spray nozzle apparatus 10 includes a base 12 which is divided generally into two portions, a rear cylindrical portion 14 and a front, generally conical portion 18. The base 12 includes a tapped bore 16 which extends into the cylindrical portion 14. The tapped bore 16 is generally centrally or axially extending with respect to the base 12. Within the generally conical portion 18 of the base 12, the bore 16 communicates with a second, intermediate bore 20. The bore 20 in turn communicates with an outlet bore 22.

The outlet bore 22 is generally parallel to the tapped bore 16, and it is disposed eccentrically with respect to the longitudinal or central axis of the base 12. The bore 22 is thus parallel to the central, longitudinal axis of the base 12, but it is offset therefrom. The intermediate bore 20 comprises a connecting bore which extends between the outlet bore 22 and the tapped bore 16. The tapped bore 16 is an inlet bore which receives fluid to be sprayed from an appropriate externally threaded conduit.

The base 12 includes a front face 24 at the front or forward portion of the base, remote from the cylindrical portion 14. The front face 24 is substantially perpendicular to the longitudinal axis of the base 12. The outlet bore 22 extends inwardly from the front face 24 to communicate with the intermediate bore 20. For simplicity in machining, the bores 20 and 22 may simply be a single bore extending at an angle between the bore 16 and the face 24.

A tapped aperture or bore 26 extends inwardly from the front face 24 substantially coaxially with the longitudinal axis of the base 12, and accordingly substantially coaxial with the tapped bore 16. The diameter of the tapped bore 26 is, however, substantially less than that of the tapped entry bore 16.

A pin 28 extends outwardly from the front face 24 of the base 12. The pin 28 is appropriately secured to the conical portion 18 of the base 12 diametrically opposed to the bore 22. That is, the bore 22, the central tapped aperture 26, and the pin 28 are aligned on a common diameter of the front face 24. The pin 28, like the bore 22, is spaced apart from the longitudinal axis of the base 12.

A gasket 30 is disposed against the front face 24 of the base 12. The gasket 30 includes a central aperture 24 which is aligned with the central, tapped aperture 26 of the base 12. The gasket 30 also includes two other apertures, an aperture 32 and an aperture 36. The aperture 32 is aligned with the aperture 22 of the base 12, and the aperture 36 is aligned with the pin 28. The pin 28 extends through the aperture 36 and outwardly from or beyond the gasket 30. As with respect to the apertures 22 and 26 and the pin 28, the apertures 32, 34, and 36 of the gasket 30 are aligned on a diameter of the gasket 30.

On the opposite side of the gasket 30, remote from base 12, is a flow control plate 40. The flow control plate 40 includes two flat and generally parallel faces 42 and 44. The face 42 is the front face, and the face 44 is the rear face. The rear face 44 is disposed against the gasket 30. The front face 42 faces a spray element 60. The flow control plate 40 includes a central aperture 46 which extends through the flow control plate on the longitudinal axis thereof. The flow control plate 40 is generally of a relatively short, cylindrical configuration, as is the gasket 30. The thickness of the flow control plate 40 is slightly greater than the thickness of the gasket 30. The central aperture 46 of the flow control 40 is aligned with the central aperture 34 of the gasket 30.

The flow control plate 40 includes three flow control apertures which extend through the plate. The apertures include a large aperture 48, a small aperture 50, and a medium aperture 52. The terms "large", "small", and "medium" refer to the flow through the plate of the fluid to be sprayed. The flow control apertures 48, 50, and 52 may be sequentially aligned with the aperture 32 in the gasket 30, which is in turn aligned with the bore 22 in the base 12 to allow for the flow of fluid from the base 12 and through the flow control plate 50. The movement or rotation of the flow control plate 40 is accomplished by means of a pin 56 which extends radially outwardly from the flow control plate 40. The small diameter or flow control aperture 50 and the pin 56 are aligned on a diameter of the flow control plate 40.

Extending inwardly from the rear surface 44 of the flow control plate 40 is an arcuately extending slot 54. The slot 54 extends arcuately for a distance of about 120°, and the slot 54, throughout its length, is concentrically disposed with respect to the central aperture 46. As best shown in FIG. 3, the pin 28 extends into the slot 54. The slot 54 accordingly defines a cam slot which receives the pin 28 of the base 12 for purposes of aligning the flow control holes 48, 50, and 52 with the bore 22. The flow control holes 48, 50, and 52 are selectively aligned with the bore 22, and also with the aperture 32, to control the flow of fluid to be sprayed.

The arcuate length of the slot 54 is correlated with the arcuate distance or spread of the holes 48 and 52, such that movement of the flow control plate 40 in one direction aligns the large flow control aperture 48 with the bore 22, and the full movement of the flow control plate 40 in the opposite direction aligns the medium sized hole or aperture 52 with the bore 22.

The pin 56 cooperates with the pin 28 and with the slot 54 for aligning the holes 48 and 52 with the bore 22. The centering of the pin 56 aligns the small hole 50 with the aperture 22. This position is shown in FIG. 3. For the alignment of the hole 50 with the bore 22, the pin 56 cooperates with an indexing slot 58 which extends axially along the "top" of the base 12. When the pin 56 is aligned with the slot 58, the small hole or aperture 50 is aligned with the delivery or outlet bore 22 of the base 12.

The internal configuration of the holes or apertures 48, 50, and 52 may vary, as appropriate for the delivery of the desired quantity of fluid to be sprayed and as appropriate to contribute to the smooth flow of the fluid. For example, in FIG. 3, it may be seen that the hole or aperture 50, which acts as a delivery nozzle, is somewhat conically configured, with an inward taper from a maximum diameter at the aperture 32 of the gasket 30 to a minimum diameter at the front face 42 of the flow control plate 40.

For maximum fluid quantity delivery, the hole or aperture 48 may be of a generally cylindrical configuration, extending through the flow control plate 40 with a constant diameter. The medium sized bore or hole 52 may have an inward taper, similar to that of the smallest bore or hole 50, but with less of a taper so as to provide a flow, quantitatively, between that allowed by the large hole 48 and that allowed by the small hole 50.

The smallest hole or bore 50, as shown in FIG. 3, is of a generally conical configuration. It has an inlet diameter substantially the same as the diameter of the outlet bore 22 of the base 12 and of the aperture 32 and the gasket 30. From the gasket 30, the bore 50 tapers inwardly to a minimum diameter at the front face 42. The maximum diameter of the bore 50 is at the rear face 44, and the diameter of the bore 50 is minimum at the front face 42.

The bore 50 may not be axially symmetrical. Rather, the bore 50 may be asymmetrical so as to provide one edge or portion of the bore at the face 42 substantially tangent to the inner portion of a spray face, such as spray face 74 of spray element 60, as shown in FIG. 3. The flow from the exit portion of the bore 50 is directly onto a spray face at its inner portion The spray face determines the pattern of the spray from the nozzle apparatus 10. This will be discussed in detail below.

Disposed adjacent to the flow control plate 40 is the spray element 60. The spray element 60 includes a body 62 which is generally cylindrical in configuration, and it includes a pair of end faces, namely a front end face 64 and a rear end face 66. The rear face 66 is disposed against the front face 42 of the flow control plate 40.

Extending axially through the body 62 of the spray element 60 is a central aperture 68. The central aperture 68 is aligned with the central aperture or hole 46 in the flow control plate 40 and with the central apertures 34 and 26 in the gasket 30 and the base 12, respectively. A pin 70 extends upwardly, or radially outwardly from, the body 62. The pin 70 is a positioning element used to move or to rotate the body 62 around the central aperture 68, substantially identical to the way the pin 56 is used to move the flow control plate 40, as has been discussed above.

Three spray faces 72, 74, and 76 are cut into the body 62 and extend from the rear face 66. The spray faces extend arcuately a predetermined length, and they extend axially with respect to the body 62 from the rear face 66 a predetermined distance, each of which distances is different for the respective three spray faces. Thus, the spray pattern emanating from each of the three faces is different.

Spray face 74 extends axially from the rear face 66 a relatively short distance, as shown in FIG. 3. This results in a relatively fine spray pattern.

The face 72, as shown in FIG. 2 and in FIG. 4, extends axially from the rear face 66 a relatively long distance, and a relatively heavy spray pattern results.

The spray face 76 results in a medium spray pattern, and its axial length is between that of the spray face 74 and the spray face 72. The face 76 is shown in FIGS. 2 and 5.

At the rear face 66, the spray faces 72, 74, and 76 all extend generally axially and then curve radially outwardly, defining a compound curve, or a curve in two dimensions. The two dimensions include the arcuate length of each spray face and the second direction is the linear or axial length of the spray face measured from the face 66 axially with respect to the body 60. The spray faces terminate at the cylindrical outer surface of the body 62, as is best shown in FIGS. 1 and 2. FIGS. 3, 4, and 5 also show the spray faces.

The greater the axial length of a spray face, the less of an angle of the spray face from the rear face 66 of the body 62 outwardly to the cylindrical outer surface of the body 62. The less the angle of a spray face, the coarser the spray pattern. Conversely, the shorter the axial length of the spray face, the greater the angular extent of the spray face, and the finer the spray pattern emanating from the spray face. Thus, the spray face 74, which extends axially a relatively short distance with respect to the length of the spray face 72, will provide a finer spray than a longer spray face, such as the spray face 72, will provide. The face 76 which has an axial length between those of the spray faces 74 and 72, produces a medium spray pattern which is between the relatively fine spray pattern from the short face 74 and the relatively coarse spray pattern from the long face 72.

The relative axial length of the spray faces 72, 74, and 76 may be best understood from FIGS. 4 and 5, which comprise side views of the spray element 60. The element 60 is shown rotated axially in FIGS. 4 and 5 from the position shown in FIG. 3.

Extending forwardly from the front face 64 of the spray element 60 is a pin 78. The pin 78 extends into a slot 104 in a front cap 90. The arcuate length of the slot 104 limits the arcuate movement of the spray element 60 and accordingly positions the spray faces 72 and 76 in appropriate alignment with a spray aperture in the flow control plate 40.

The front cap 90 includes a cylindrical portion 92 which has a rear face 94 disposed against the front face 64 of the spray element 60 when the spray nozzle apparatus 10 is secured together. The cap 90 also includes a rounded front portion 96 which has a relatively flat front face 98. The diameter of the flat front face 98 is less than that of the rear face 94, as may best be understood from FIGS. 1 and 3.

A bore 100 extends axially through the center of the cap 90. The bore 100 communicates with a counterbore 102 which extends inwardly from the rear face 94. The slot 104 extends inwardly from the face 94 and arcuately about the counterbore 104.

The cap 90 also includes a relieved portion 106 in the rounded front portion 96. A tapped aperture 108 extends from the relieved portion 106 radially inwardly to communicate with the bore 100. The tapped aperture 108 receives a set screw 110, shown in FIG. 3.

For securing together the base 12, the gasket 30, the flow control plate 40, the spray element 60, and the cap 90, a pin 120 is used. The pin 120 includes a threaded portion 122 which extends into the tapped aperture 26 of the base 12. The set screw 110 is used to secure the cap 90 to the pin 120.

The pin 120 holds the five elements of the spray nozzle apparatus 10 together, and it serves as a shaft on which the spray element 60 and the flow control plate 40 pivot. The axis of rotation or of pivoting of the flow control plate 40 and of the spray element 60 is on the center line of the spray nozzle apparatus 10, as defined by the longitudinal axis of the pin 120. The cap 190 remains in a fixed position with respect to the base 12 by virtue of the pin 120 and of the set screw 110.

The pin 28, extending forwardly from the front face 24 of the base 12, is used to index or to lock together in a nonrotatable manner the gasket 30 and the base 12. At the same time, the pin 28 serves to index the aperture 32 in the gasket 30 to the exit or outlet bore 22 of the base 12.

The flow control plate 40 pivots under movement of the pin 56 which extends radially outwardly from the center of rotation of the flow control plate 40, which is along the axis of the pin 120. The pivoting or rotary movement of the flow control plate 40 is limited by the arcuate length of the slot 54 and the pin 28. The flow control plate 40 thus moves relative to the base 12 and also relative to the spray element 60.

The rotation or pivoting movement of the spray element 60 is limited by the pin 78 and its slot 104 in the cap 90. The spray element 60 is rotated to provide a desired spray pattern.

The spray element 60 and the flow control plate 40 are independently relatively movable so that a user may select any of three flow rates and any of three spray patterns by appropriate movement of the pins 56 and 70 in the flow control plate 40 and in the spray element 60, respectively. The various pins csoperating with the arcuately extending slots limit the movements of the flow control plate and of the spray element such that movements at the limits of the slots define or locate the two outer positions and the corresponding flow rates and spray patterns. The pins 56 and 70 may be aligned with the indexing slot 58 on the base 12 for the center flow rate and spray pattern, respectively.

If desired, a spray element having two spray faces may be used instead of the spray element 60, which includes three spray faces, each individually selectible.

As is known and understood, the fluid sprayed through the nozzle apparatus 10 comes from a hopper on an airplane. Each airplane usually includes a single hopper with an appropriate conduit leading from the hopper to a manifold. There is in turn a plurality of nozzles, each of which may be such as the nozzle apparatus 10, connected to the manifold. For most spray applications, a desired chemical is mixed with water in the hopper. That is, water is added to the hopper and to an appropriate chemical which is mixed with the water. The water may be taken from a ditch, a well, etc.

Regardless of the source of the water, it is generally not "clean" water in the sense that tap water is "clean" water. Thus, there is usually debris of various kinds in the water. The debris flows through the large, or relatively large, conduits between the hopper and the individual spray nozzles. However, while the debris may generally flow through relatively large holes, such as the hole 48, the debris may clog smaller holes, such as the medium sized hole 52 and the small hole 50. There accordingly should be an appropriate cleanout bore with which the holes 50 and 52 may be aligned to clean them out when they get clogged with debris. Such a cleanout bore is shown in FIGS. 1 and 3.

Extending longitudinally axially through the base 12, and offset from the central bore 26, is a cleanout bore 29. The cleanout bore 29 is aligned with a cleanout bore or aperture 38 which extends through the gasket 30. The flow control plate 40 may be rotated to sequentially align either of the bores 50 and 52 with the aligned cleanout bores 29 and 38.

The bore 29 is radially offset outwardly from the cylindrical portion 14 of the base 12 and accordingly communicates externally through the conical portion 18. A wire, or the like, may be pushed through the aligned bores 29 and 38 to clean out the bores or apertures 50 and 52 when they are aligned with the bores 29 and 38 for cleaning purposes.

As previously indicated, while three spray faces 72, 74, and 76 are illustrated and discussed, under some circumstances it may be desirable to provide a spray control element with only two spray control faces.

The spray control face 74, the shortest spray control face, axially, extends through an arc of about 90° from the rear face 66 to the outer periphery of the body 62 of the spray control element 60. The 90° arcuate spray face provides a relatively fine spray pattern.

The spray face 72 extends arcuately for about 45° and is the longest, axially, spray face. The spray face 72 provides a relatively coarse spray pattern.

The spray face 76 provides a medium spray pattern, relatively speaking. That is, the spray pattern emanating from the spray face 76 provides a spray pattern between the fine spray pattern provided by the spray face 74 and the coarse spray pattern provided by the spray face 72. The spray face 76 extends arcuately for about 67°, or about in between the arcuate extensions of the spray faces 72 and 74. Axially, the spray face 76 is also between the length of the spray faces 72 and 74.

The terms "fine" and "coarse" refer to the droplet size in the spray curtain or pattern emanating from a particular face. Thus, the fine spray pattern emanating from the spray face 74 provides a curtain of relatively small or fine droplets, while the coarse pattern emanating from the spray face 72 provides a curtain of relatively large droplets.

In addition to controlling the quantity of fluid (insecticide, etc.) flowing from the nozzle apparatus by adjustment of the flow control plate 40 to index any of the three holes or orifices 48, 50, or 52 with the outlet bore 22, the apparatus 10 includes a shutoff position. Rotating the flow control plate 40 so that the rear face 44 of the flow control plate 40, between the flow hole or orifice 50 and the middle hole or orifice 52, is disposed against the outlet bore 22, the flow of fluid from the bore 22 will stop. This position of the flow control plate 40 defines a shutoff position. By making an appropriate indexing mark or slot (not shown), similar to, but spaced apart arcuately from, the indexing slot 58 on the outer periphery of the base 12, the pin 56 may be aligned with such index slot or mark to allow the flow control plate 40 to be positioned to the shutoff position rapidly, easily, and accurately.

The primary purpose and advantage of a shutoff position is to provide a manner for further controlling the quantity of fluid flow from an aircraft. For example, if a flow quantity less than that provided by the smallest hole or orifice 50 is desired, every other (or second) nozzle out of a typical nozzle array secured to an aerial spray aircraft may be turned to the shutoff position, or any desired number of nozzles may be so shut off, to provide the desired quantity of spray from the nozzles left open.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Spray nozzle apparatus, comprising, in combination: base means, including a first central aperture, and a bore through which fluid flows to be sprayed;

flow control means for controlling the flow of fluid from the bore, including a plate, a plurality of spray holes in the plate, each of a different diameter for controlling the flow of fluid from the base means, through which the fluid selectively flows from the bore, a second central aperture aligned with the first central aperture of the base means, and means for aligning each hole of the plurality of spray holes with the bore of the base means, including an arcuate slot in one of the base means and the plate, and a first pin movable in the arcuate slot in the other of the base means and the plate whereby relative movement of the first pin and the arcuate slot allows each hole of the plurality of spray holes to be aligned with the bore through which the fluid flows to be sprayed;

spray control means, including a plurality of spray faces, each of which provides a different spray pattern and each of which is selectively movable to a spray hole of the flow control means to provide a plurality of desired spray patterns, and a third central aperture aligned with the first and second central apertures;

pin means extending through the first, second, and third central apertures to secure together the base means, the flow control means, and the spray control means, and to define an axis of rotation on which the spray control moves to selectively align a spray face with a spray hole;

front cap means spaced apart from the base means and disposed adjacent to the spray control means and secured to the pin means;

a second pin on one of the front cap means and the spray control means; and a second slot on the other of the front cap means and the spray control means for receiving the second pin and having an arcuate length to limit the arcuate movement of the spray control means to align the spray faces with a spray hole in the flow control means.

2. The apparatus of claim 1 in which the arcuate length of the first slot is correlated with the arcuate distance between two of the spray holes of the plurality of spray holes for aligning the two holes with the bore of the base means when the first pin is moved relative to the arcuate length of the first slot.

3. The apparatus of claim 1 in which the base means further includes index means for indexing the spray holes with the bore through which fluid flows.

4. The apparatus of claim 1 in which the spray control means further includes means for indexing the spray faces with respect to the flow control means.

5. The apparatus of claim 1 in which the flow control means is rotatable to a shutoff position for stopping the flow of fluid from the base means.

* * * * *